US012185782B2

(12) United States Patent
Luthman

(10) Patent No.: US 12,185,782 B2
(45) Date of Patent: Jan. 7, 2025

(54) BRA SIZE MEASURING DEVICE

(71) Applicant: Marianne Luthman, Rotherfield (GB)

(72) Inventor: Marianne Luthman, Rotherfield (GB)

( * ) Notice: Subject to any disclaimer, the term of this patent is extended or adjusted under 35 U.S.C. 154(b) by 464 days.

(21) Appl. No.: 17/774,321

(22) PCT Filed: Jul. 14, 2020

(86) PCT No.: PCT/GB2020/051690
§ 371 (c)(1),
(2) Date: May 4, 2022

(87) PCT Pub. No.: WO2021/089978
PCT Pub. Date: May 14, 2021

(65) Prior Publication Data

US 2022/0386728 A1 Dec. 8, 2022

(30) Foreign Application Priority Data

Nov. 4, 2019 (GB) ..... 1915996

(51) Int. Cl.
*A41H 1/02* (2006.01)
*A41C 5/00* (2006.01)

(52) U.S. Cl.
CPC *A41H 1/02* (2013.01); *A41C 5/00* (2013.01)

(58) Field of Classification Search
CPC ..... A41H 1/02; A41C 5/00
(Continued)

(56) References Cited

U.S. PATENT DOCUMENTS 2,575,343 A * 11/1951 Heiman ..... A41H 1/02 33/2 R
2,946,125 A 7/1960 Gittelson
(Continued)

FOREIGN PATENT DOCUMENTS

WO 0052416 A1 9/2000
WO 2018161268 A1 9/2018

OTHER PUBLICATIONS

EPO/WO. PCT/GB2020/051690, PCT Written Opinion of the International Searching Authority dated Oct. 19, 2020, (6 pgs).
(Continued)

*Primary Examiner* — George B Bennett
(74) *Attorney, Agent, or Firm* — Crawford Maunu PLLC

(57) ABSTRACT

A measuring device for determining the bra size of a user is disclosed. The device has a first (middle) band (100) for fitting around the user's bust to determine cup size, a second (lower) band (200) for fitting around the user's torso below the bust for determining band size, and a third (upper) band (300) for securing the device in position during measurement. The device also includes a panel (400) which is separable into two panel parts (410, 420) by means of a zipper (430). The first band is provided with cup size indicia (113) and the second band is provided with band size indicia (223). The second band (200) is configured to indicate the user's band size on the band size indicia (223), and the first and second bands (100, 200) are employed to determine the user's cup size on the cup size indicia (113). The panel parts (410, 420) can be separated after measurement so that the device can be removed by a user while still displaying the measurements. The band and cup size indicia may comprise any type of scale or units, depending on the sizing system employed.

16 Claims, 6 Drawing Sheets

(58) Field of Classification Search
USPC ..... 33/512, 514.1, 514, 2, 555.1
See application file for complete search history.

(56) References Cited

U.S. PATENT DOCUMENTS

| | | | | | |
|---|---|---|---|---|---|
| 3,292,261 | A * | 12/1966 | Hayes | A41H 1/02 | 33/759 |
| 5,414,943 | A * | 5/1995 | Vogt | A61B 5/107 | 33/759 |
| 6,272,761 | B1 * | 8/2001 | Pechter | G01B 3/02 | 33/759 |
| 6,276,069 | B1 * | 8/2001 | Chadwick | A41H 1/02 | 235/78 R |
| 6,336,839 | B1 * | 1/2002 | Valli | A41H 1/02 | 450/63 |
| 6,751,877 | B2 * | 6/2004 | Grove | A41H 1/02 | 33/562 |
| 8,832,955 | B2 * | 9/2014 | Petter | A41H 1/02 | 33/759 |
| 9,568,296 | B2 * | 2/2017 | Moore | A61B 5/4312 | |
| 10,973,271 | B2 * | 4/2021 | D'Antonio | G01B 3/1061 | |
| 11,969,029 | B2 * | 4/2024 | Liu | A41C 3/12 | |
| 2020/0000165 | A1 * | 1/2020 | Wang | A41H 1/00 | |
| 2022/0071313 | A1 * | 3/2022 | Cheng | A41C 3/12 | |

OTHER PUBLICATIONS

EPO/ISR. PCT/GB,2020/051690, PCT International Search Report dated Oct. 19, 2020, (2 pgs).

* cited by examiner

BRA SIZE MEASURING DEVICE

TECHNICAL FIELD

The invention relates to a bra size measuring device and in particular to a bra size measuring device which simultaneously indicates the user's band size and cup size.

BACKGROUND

Bra sizes are typically defined in their most basic form by means of a band size, which is the circumference of the user's torso just above or just below the bust, and a cup size, which is the difference between the band size and the circumference around the fullest part of the user's bust. Band size may be expressed in terms of an actual circumference measurement or converted into another value such as band number. Cup sizes are typically converted into a letter (A, B, C, etc.) to denote the difference between the two circumferences, which provides a user's size in a format which is easier to remember.

Bra size measuring devices are known, the most basic form of which is the tape measure. However, the two measurements must be taken separately, followed by a subtraction and then cross-referencing to the appropriate cup size letter based on the result.

Measuring devices have been developed which attempt to overcome the issues with basic devices such as the tape, and which attempt to provide the two basic measurements simultaneously. Examples are disclosed in U.S. Pat. Nos. 2,575,343, 6,276,069 and US 2015/0089824.

The present invention provides an improved bra size measuring device compared to known devices.

SUMMARY OF THE INVENTION

In accordance with the invention, there is provided a measuring device for determining the bra size of a user, comprising:

a first band and a second band, and a panel which is separable into two panel parts, wherein each band comprises first and second separable band parts, each band part having a first end and a second end, wherein the first ends are attached to different parts of the panel and wherein attachment means are provided to releasably attach the second ends in overlapping relation to form a complete loop of variable length around the user's torso when the panel parts are connected;

wherein the first band is provided with cup size indicia and the second band is provided with band size indicia;

wherein the device has a pre-measurement configuration in which the panel parts are connected and the second ends of each respective band are separated such that the band parts extend from each panel part in opposing directions;

wherein the device has a measurement configuration in which the second ends of each band are attached to form complete loops around the user's torso, the first band is configured to form a loop fitting around the user's bust and the second band is configured to form a loop above or below the user's bust fitting around the user's torso; and wherein the device has a post-measurement configuration in which the second ends of each band remain attached and the panel is separated into two parts such that the device can be removed from the user, and in which the second band is configured to indicate the user's band size on the band size indicia, and the first and second bands are employed to determine the user's cup size on the cup size indicia.

For further clarification, preferred arrangements of the pre-measurement, measurement and post-measurement configurations are shown in the figures described below.

In a preferred embodiment, the measuring device further comprises a third band which is configured to form a loop below or above the user's bust around the user's torso to secure the device in position when in the measurement configuration. In one embodiment, this third band would be the upper band, the first band would be the middle band and the second band would be the lower band. In an alternative embodiment, this third band would be the lower band, the first band would be the middle band and the second band would be the upper band.

In the following description, references to "exterior", "overlie", etc. are when viewed from the side of the device which is visible on the outside of the user in the measurement configuration.

The second ends of the first band parts are preferably configured to overlie the second band parts in the measurement and post-measurement configurations.

The cup size indicia are preferably located on an exterior surface of the first part of the first band, and more preferably at or adjacent the second end of the first part. The cup size indicia may comprise alphabetical, numerical or alphanumerical characters. The cup size indicia may be formed from a scale in units of length, such as inches or centimetres or both, to indicate the actual circumference measured, or any other scale or sequence such as the standard industry alphabetical cup size scale (AA, A, B, C, etc.). Two or more scales of different units or systems may be provided.

As mentioned above, cup size is the difference between the band size and the circumference around the fullest part of the user's bust. In the invention, this is the relative difference between the sizes of the loops formed by the first and second bands. The first and second bands are employed to determine the user's cup size on the cup size indicia. In one embodiment, the indicated band size on the second band may be employed to read off the user's cup size on the cup size indicia on the first band. Alternatively, part of the second band (such as the second end of the first part) may be employed to read off the user's cup size from the first band.

In a preferred embodiment, first and second bands are configured to indicate the user's cup size on the cup size indicia. One or more cup size markers may be provided on the second band for indicating the cup size on the cup size indicia on the first band. The cup size marker may simply comprise a line, arrow or the like which points to the appropriate cup size indicium. A cup size marker may be located on an exterior surface of the first part of the second band, and may be located at or adjacent the second end of the first part. As an alternative, one or more cup size markers may be provided on the second band adjacent to the band size indicia.

The band size indicia are preferably located on an exterior surface of the second part of the second band. The band size indicia may be located on an exterior surface of an extension panel depending from the second part of the second band. The band size indicia may comprise alphabetical, numerical or alphanumerical characters. The band size indicia may be formed from a scale in units of length, such as inches or centimetres or both, to indicate the actual circumference measured, or any other scale or sequence such as the standard industry band number scale (32, 34, 36 etc.). Two or more scales of different units or systems may be conveniently provided.

In some measurement systems, including the standard band number system mentioned above, a given band size/number may cover a predetermined range of actual sizes within it. In this case, the device may be used or configured to determine the appropriate cup size by reading across from the centre of the range of the specific band number which is indicated by the second band to the cup size indicia on the first band.

The band size may be indicated by the location of the second end of the first part of the second band which overlies the indicia/scale on the second part of the second band. In a preferred embodiment however, the measuring device further includes a band size marker to indicate the user's band size on the band size indicia. Preferably, the band size marker is located on an exterior surface of the first part of the second band, and more preferably at or adjacent the second end of the first part. The band size marker may simply comprise a line, arrow or the like which points to the appropriate band size indicium.

Additional size indicia may be provided on the first, second or third bands. For example, additional band size indicia may be provided on the first and/or third bands.

In the pre-measurement configuration, the panel parts are connected and the second ends of each respective band are separated such that the band parts extend from each panel part in opposing directions. In general, when considering the device in a laid-flat condition, the band parts will preferably extend in opposite, parallel directions (see FIGS. 1 and 2 below), although it is not necessary for the directions to be strictly parallel due to the configuration of the device and the materials from which the device may be constructed. The requirement is that the first ends of the band parts are attached to different parts of the panel and the band parts extend in different directions sufficient that they can attach to form loops about the user.

The panel may comprise any suitable configuration to separably connect the first ends of the bands together. In its simplest form, the panel may just be means to separably connect the first ends together, such as a panel of a hook-and-loop attachment system. In a preferred embodiment, the panel is a distinct panel which is separable into two parts. The panel may be rectangular or square, or have any other suitable shape. The first ends are preferably permanently attached to the panel parts, whereas the second ends are releasably attached together to form the loops described. The panel may be separable into two panel parts by any suitable means such as hook-and-loop, clips or poppers, but preferably a zipper is provided for this purpose.

The second ends of the bands are releasably attached together to form the loops described. Any suitable means which allows overlapping attachment of the band parts may be provided, for example clips, sliders, buckles or poppers, but preferably a hook-and-loop system is provided.

In the post-measurement configuration, the band size is indicated by the absolute size of the loop formed by the second band (whether in units of actual length or by another system) and, in at least preferred embodiments, can be directly read off the band size indicia or scale, as indicated by the second end of the first band part and/or the position of the band size marker.

Cup size is determined by the relative difference between the sizes of the loops formed by the first and second bands, the first band indicating the bust circumference and the second band indicating the torso circumference just above or below the bust. This is determined without calculation in the present invention by employing the second band to indicate the appropriate cup size on indicia or a scale provided on the first band. If a cup size marker is provided, preferably the cup size indicia and the cup size marker are configured to lie adjacent to each other in the post-measurement configuration.

For accurate determination of cup size, it is important that the "variable-length" sections of the first and second bands are laid side-by-side (preferably flat) in the post-measurement configuration. In preferred embodiments, the variable-length section is at least the part of the loop comprising the second part from the panel up to and including the cup size indicia/scale and the cup size marker or the part of the second band which is employed to indicate the cup size. Preferably, the second parts of the first and second bands and the second ends of the first parts of the first and second bands are laid flat in the post-measurement configuration to determine the user's cup size.

The present invention may be configured to provide additional measurements, which may be required for a bespoke bra. As mentioned above, the first and/or third bands may be provided with band size indicia, in addition to the indicia/scale provided on the second band. Any band may be provided with two or more scales of different units or measurement scales or systems.

In a further enhancement of the present invention, one or more of the bands may be provided with attachment means on their exterior surfaces for the attachment of one or more additional markers. These markers may take any suitable form such as indicators, pointers or sticks. The markers may be configured to be located at the edges of the user's bust, for measuring bust width (to give a measurement for the width of the bra frame). Alternatively or in addition, a central marker or scale may be located centrally to indicate a vertical distance between the bands (e.g. between the second and third bands), to give a measurement for the diameter of the cups.

The attachment means may comprise any suitable system for attaching the markers, such as clips or poppers, but preferably a hook-and-loop system is provided.

Preferably, the measurement device is made from a flexible material such as a fabric. Preferably the device is washable.

In at least preferred embodiments, the invention provides a bra size measuring device which can be removed from the user while still retaining the indicated measurements. Therefore, the device can be more easily used by someone on their own. The measurements are also easier to read off with the device in front of the user, e.g. on a table, as opposed to when being worn.

Further, the method of measurement and how the device simultaneously indicates band and cup size are much simpler than prior art devices. The arrangement of two (or three) bands is straightforward and easy to use. The second band indicates the band size and is also used to automatically indicate the cup size on the first band. The relative differences in the band lengths is already taken into account to show the cup size, and there is no calculation to do. The invention avoids the use of complex and fiddly straps, buckles, sliders and dials found in the prior art devices.

The measuring device of the invention therefore provides significant advantages over prior art devices.

Additional advantages of at least preferred embodiments are:

all-in-one device;

device is put on by wrapping around the torso and fastening at the front;

device is taken off by undoing a zip, which can be swivelled to the front if necessary for easier undoing, by virtue of there being no shoulder straps;

device can be used to measure with or without bra on; and the whole device is removed with a single zip.

Further advantages will become apparent from the detailed description of preferred embodiments of the invention below.

BRIEF DESCRIPTION OF THE DRAWINGS

Embodiments of the invention will now be described by way of example only and with reference to the accompanying drawings, in which.

DETAILED DESCRIPTION OF PREFERRED EMBODIMENTS

Figure 1:
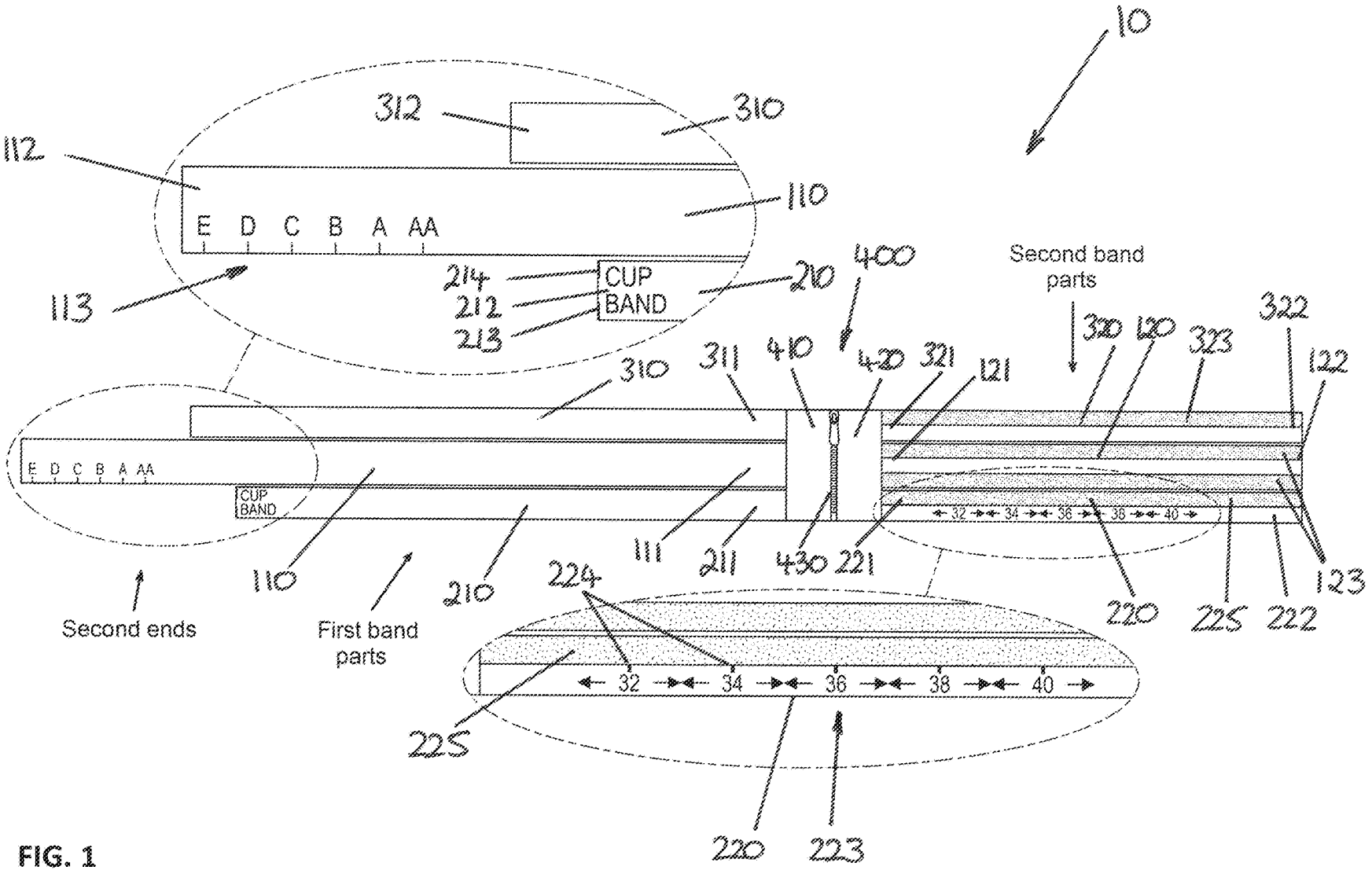
FIG. 1 shows a plan view of the outside of a measuring device in accordance with a first embodiment, in a pre-measurement configuration.
Figure 2:
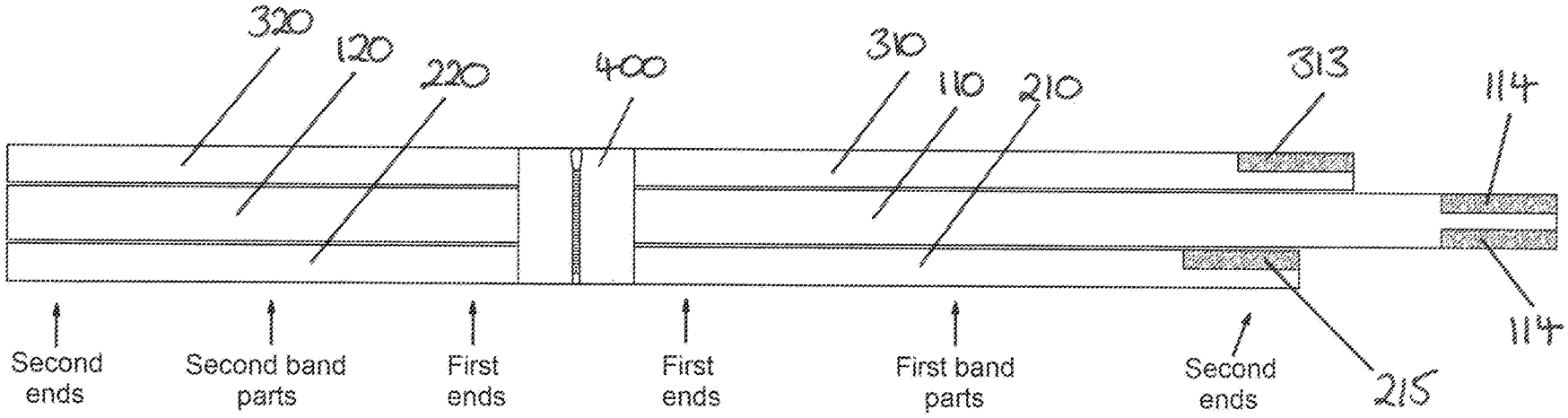
FIG. 2 shows a plan view of the inside of the measuring device of FIG. 1.

A first embodiment of the invention will be described with reference to FIGS. 1 to 6. With reference to FIGS. 1 and 2, a bra size measuring device 10 is shown in a pre-measurement configuration.

Measuring device 10 comprises first (middle) band 100, second (lower) band 200, third (upper) band 300 and panel 400. As described below, each band is formed from two elongate strips of material which are each permanently attached to the panel 400 at one end and are releasably attachable together at the other ends in overlapping relation to form a complete loop of variable length around the user's torso.

Panel 400 is formed from a first panel part 410 and a second panel part 420 which are separable by a zipper 430. The panel parts are generally rectangular and when attached for a generally rectangular or square panel 400.

First band 100 comprises first band part 110 and second band part 120 which are attachable to form a first loop. First band part 110 has a first end 111 which is permanently attached to the first panel part 410 and a second end 112. Second end 112 is provided with an alphabetical cup size scale 113 on the outside (FIG. 1) and two strips 114 of hook-and loop material on the inside (FIG. 2). Second band part 120 has a first end 121 which is permanently attached to the second panel part 420 and a second end 122. Two strips 123 of hook-and loop material are provided on the outside, along the length of the second band part 120 (FIG. 1).

Second band 200 comprises first band part 210 and second band part 220 which are attachable to form a second loop. First band part 210 has a first end 211 which is permanently attached to the first panel part 410 and a second end 212. Second end 212 is provided with a band size marker 213 and a cup size marker 214 on the outside (FIG. 1) and a strip 215 of hook-and loop material on the inside (FIG. 2). Second band part 220 has a first end 221 which is permanently attached to the second panel part 420 and a second end 222. A band size scale 223 (in this embodiment, showing band number) is provided on the outside of second band part 220. Each band number represents a range of actual band sizes. The centre of the range for the indicated band number may be specified for reading off cup size, and therefore as an alternative to cup size marker 214 on the first band part 210, cup size markers 224 indicating the centre of each band number range may be provided (see FIG. 1 enlargement). A strip 225 of hook-and loop material is also provided on the outside of second band part 220, along the length of the second band part 220 (FIG. 1).

Third band 300 comprises first band part 310 and second band part 320 which are attachable to form a third loop. First band part 310 has a first end 311 which is permanently attached to the first panel part 410 and a second end 312. Second end 312 is provided with a strip 313 of hook-and loop material on the inside (FIG. 2). Second band part 320 has a first end 321 which is permanently attached to the second panel part 420 and a second end 322. A strip 323 of hook-and loop material is also provided on the outside, along the length of the second band part 320 (FIG. 1)

Figure 3:
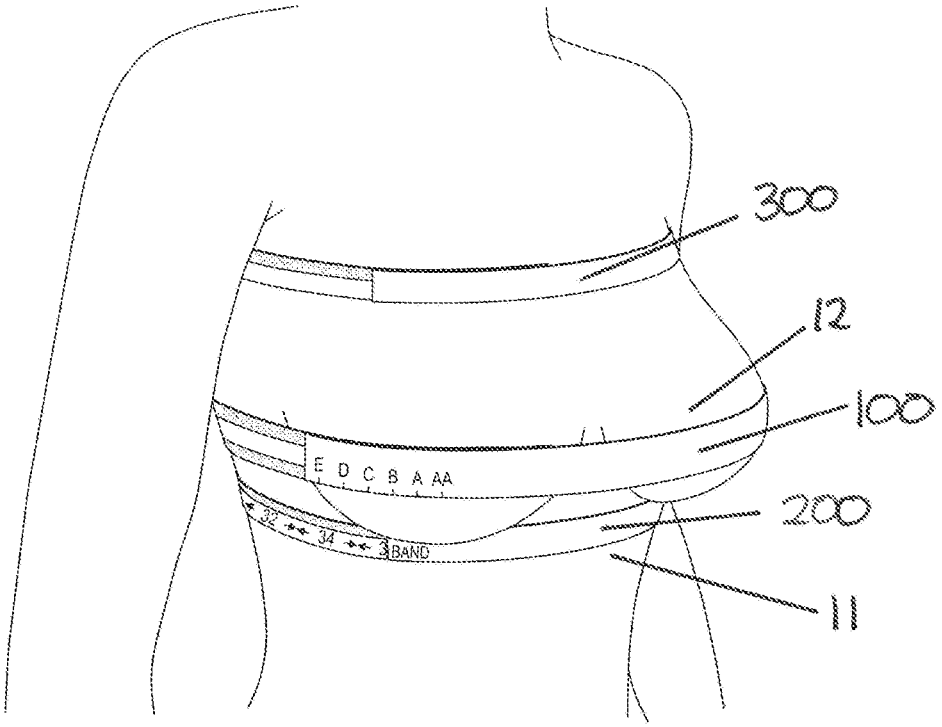
FIG. 3 shows a front perspective view of the measuring device of FIG. 1 in a measurement configuration.
Figure 4:
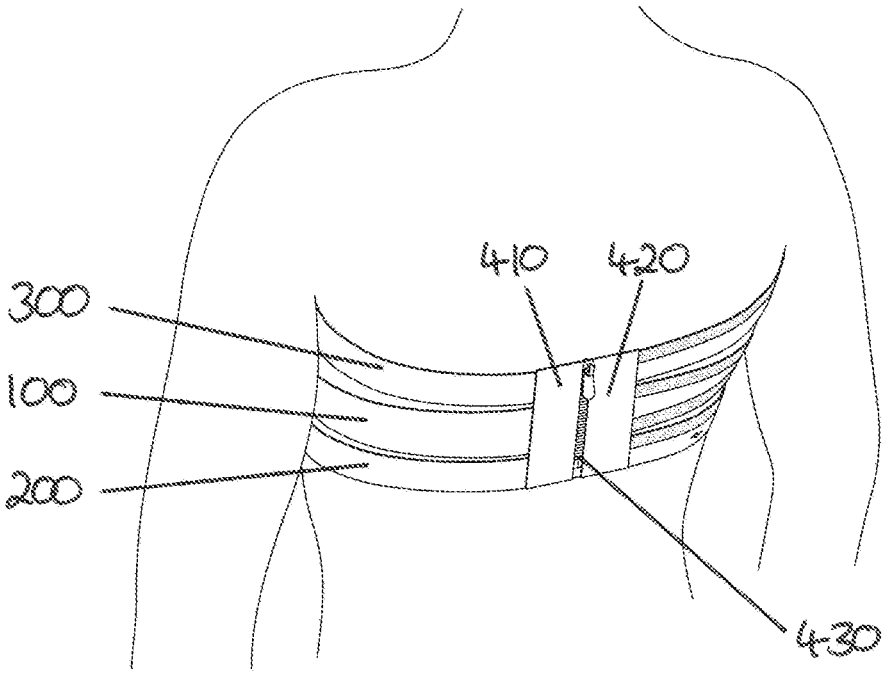
FIG. 4 shows a rear perspective view of the measuring device of FIG. 1 in a measurement configuration.

Turning to FIGS. 3 and 4, the bra size measuring device 10 is shown in a measurement configuration in position on a user's torso 11 and about the user's bust 12. The device 10, in the pre-measurement configuration with the panel parts 410 and 420 attached and the second ends of all band parts unattached, is taken and placed in position with the panel 400 at the user's back. The second ends of the third (upper) band 300 are attached by means of the hook-and-loop strips 313 and 323 around the front of the user first to form a loop around the user, above the bust 12, to secure the device in position.

Next, the second ends of the second (lower) band 200 are attached by means of the hook-and-loop strips 215 and 225 to form a loop around the user, just below the bust 12. This loop will indicate the user's band size. Finally, the second ends of the first (middle) band 100 are attached by means of the hook-and-loop strips 114 and 123 to form a loop around the user, around the fullest part of the bust 12. This loop will be used to indicate the user's cup size in combination with the second band. The order of attachment of the first and second bands may be reversed.

In this configuration, the device is then removed from the user's torso by undoing zipper 430 to separate the panel 400 into two parts 410 and 420. The panel 400 may be swivelled around to the front for easier separation.

Figure 5:
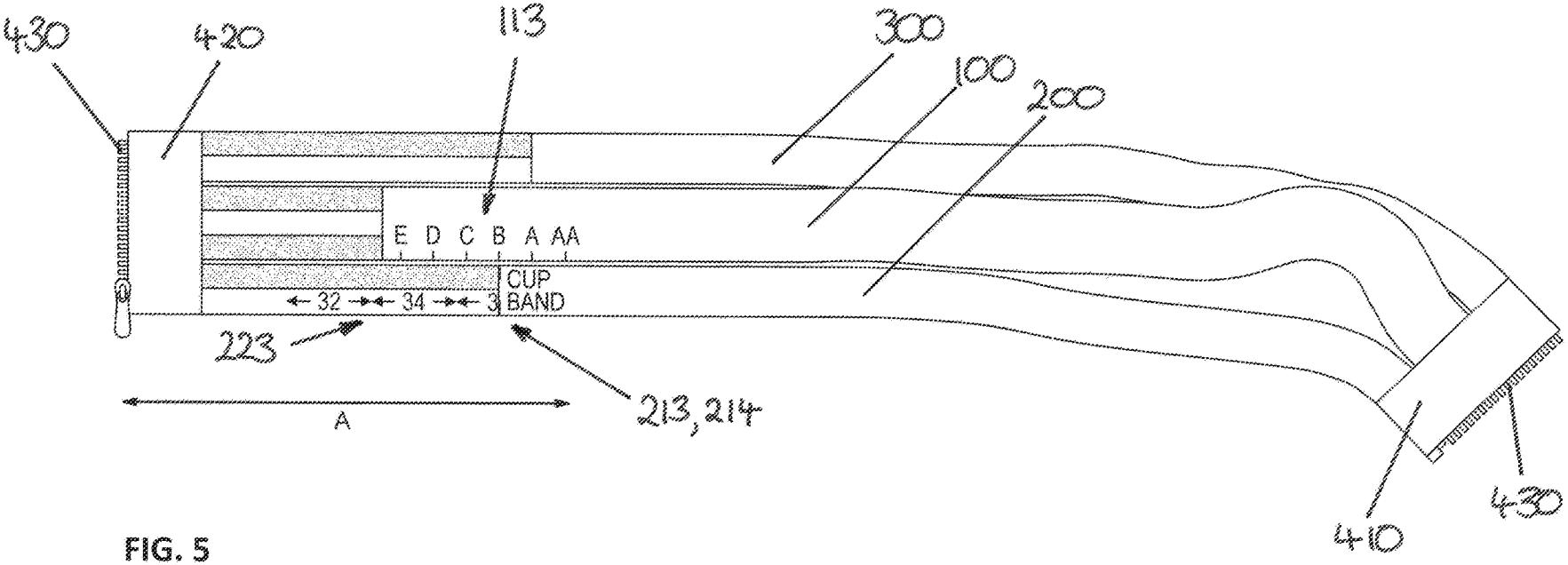
FIG. 5 shows a plan view of the measuring device of FIG. 1 in a post-measurement configuration.
Figure 6:
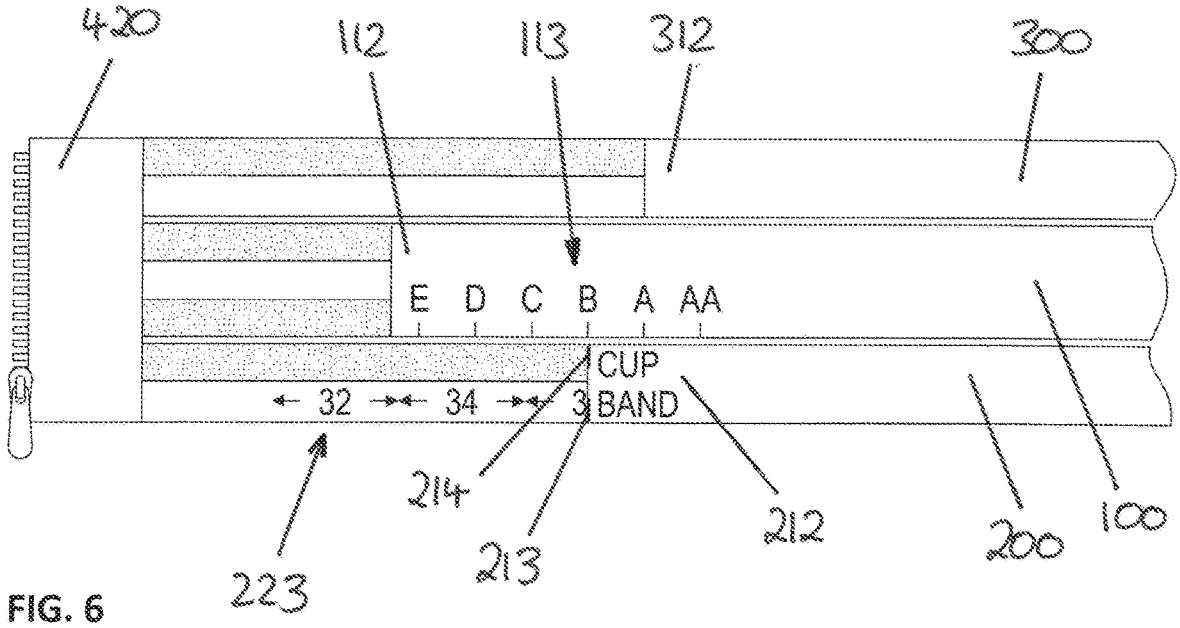
FIG. 6 shows an enlargement of FIG. 5 showing the scales in more detail.

The device 10 is now in the post-measurement configuration as shown in FIGS. 5 and 6. FIG. 6 shows an enlargement of the scales of FIG. 5 for clarity.

The measurements can be read from the device by laying the device on a surface and ensuring that the section from the second panel part 420 up to the scales is laid flat (shown by arrow A). Because the loops formed by the bands will be of different lengths, the other end of the device will be "rucked up" as shown.

The user's band size (band number) is read from the second band 200, where indicated on the band size scale 223 by the band size marker 213. The user's cup size (alphabetical) is read from a combination of the first band 100 and second band 200, where indicated on the cup size scale 113 on the first band 100 by the cup size marker 214 on the second band 200. The resulting measurement in this example is 36B.

In this example, the user's actual band size is in the centre of the range for band number 36. Therefore, if the centre of the range for the indicated band number is specified for reading off cup size, the user's cup size can be read off directly at this point using the cup size marker 214 (or the location of the end 212 of the first band part 210 if no cup size marker 214 is provided). If the user's actual band size is not in the centre of the range for a band number, instructions may specify that the centre of the indicated band number range should be used to read off the cup size. The cup size marker 214 may be repositioned to the centre of the band number for this. Alternatively, as mentioned above, cup size markers 224 (FIGS. 1 and 7) in the centre of each band number range may be provided to facilitate this determination.

Figure 7:
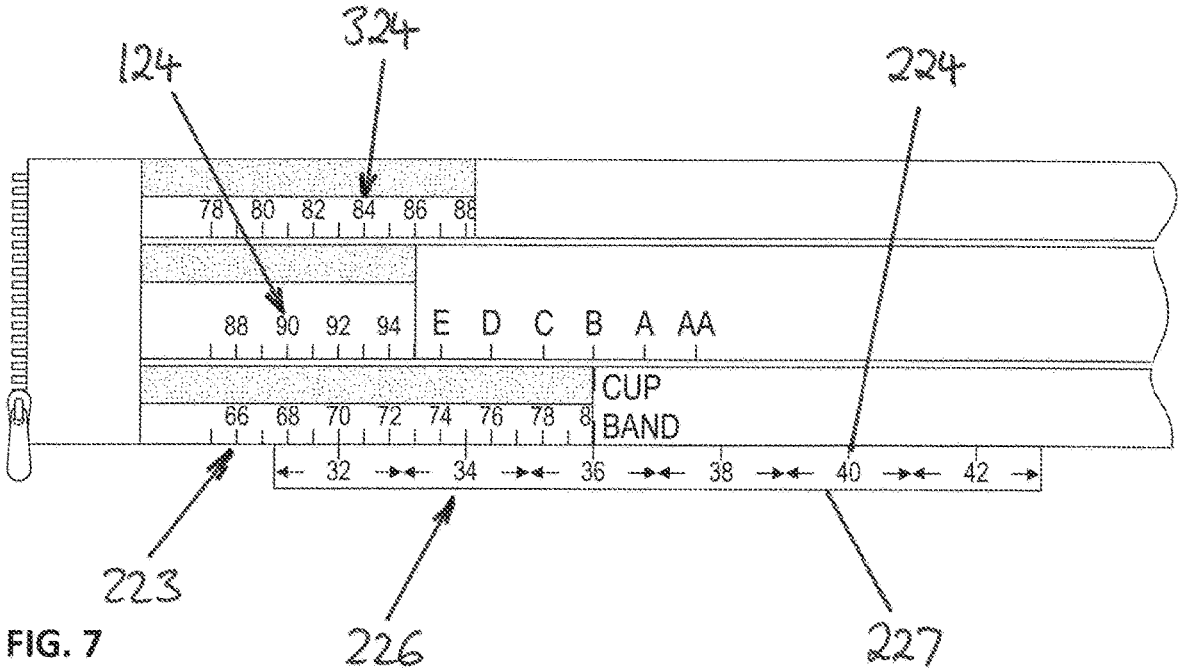
FIG. 7 shows an enlargement of the scales of a measuring device in accordance with a second embodiment in a post-measurement configuration.

FIG. 7 shows an enlargement of the scales of a measuring device in accordance with a second embodiment in a post-measurement configuration. The only significant difference compared to the first embodiment is the provision of additional band size scales for increased accuracy of measurement. The device is used in the same manner as described for the first embodiment.

First band 100 is provided with a band size scale 124 (in centimetres) on the outside of second band part 120, which replaces one of the hook-and-loop strips 123.

With reference to second band 200, band size scale 223 is shown in centimetres in this embodiment and a second band size scale 226 in band number is provided on the exterior surface of extension panel 227 adjacent to depending from the second part 220 of the second band 200. The band size can therefore be indicated in different units/scales or systems.

Third band 300 is provided with a band size scale 324 (in centimetres) on the outside of second band part 320.

Figure 8:
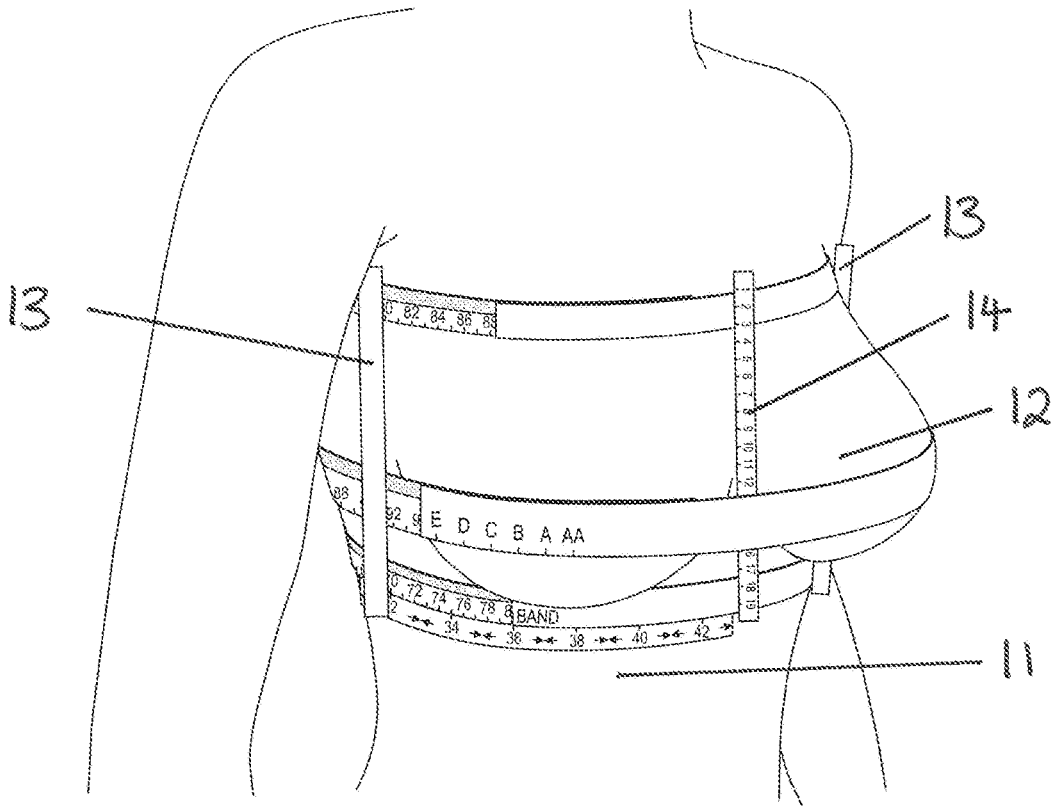
FIG. 8 shows a front perspective view of a measuring device in accordance with a third embodiment in a measurement configuration.

FIG. 8 shows a front perspective view of a measuring device in accordance with a third embodiment in a measurement configuration. This device is a modification of the second embodiment described above and includes markers for providing additional measurements. In this embodiment, a pair of edge markers 13 in the form of "sticks" are located at the edges of the user's bust 12, for measuring bust width (to give a measurement for the width of the bra frame). A tape measure may be used to determine the distance between the markers 13. A central marker or scale 14 is also shown, which is attached between the second and third bands 200, 300, underneath the first band 100, and indicates a vertical distance between the bands to give a measurement for the diameter of the cups.

The markers 13 and 14 and the exterior surfaces of the bands may be provided with a hook-and-loop attachment system, which may include utilisation of the existing hook-and-loop strips referred to above, to enable the markers to be fixed in position.

The invention claimed is:

1. A measuring device for determining the bra size of a user, comprising:

a first band and a second band, and a panel which is separable into two panel parts, wherein each band comprises first and second separable band parts, each band part having a first end and a second end, wherein the first ends are attached to different parts of the panel and wherein attachment means are provided to releasably attach the second ends in overlapping relation to form a complete loop of variable length around the user's torso when the panel parts are connected;

wherein the first band is provided with cup size indicia and the second band is provided with band size indicia;

wherein the device has a pre-measurement configuration in which the panel parts are connected and the second ends of each respective band are separated such that the band parts extend from each panel part in opposing directions;

wherein the device has a measurement configuration in which the second ends of each band are attached to form complete loops around the user's torso, the first band is configured to form a loop fitting around the user's bust and the second band is configured to form a loop above or below the user's bust fitting around the user's torso; and wherein the device has a post-measurement configuration in which the second ends of each band remain attached and the panel is separated into two parts such that the device can be removed from the user, and in which the second band is configured to indicate the user's band size on the band size indicia, and the first and second bands are employed to determine the user's cup size on the cup size indicia.

2. The measuring device of claim 1, further comprising a third band which is configured to form a loop below or above the user's bust to secure the device in position.

3. The measuring device of claim 1, wherein the second ends of the first band parts are configured to overlie the second band parts in the measurement and post-measurement configurations.

4. The measuring device of claim 1, wherein the cup size indicia are located on an exterior surface of the first part of the first band.

5. The measuring device of claim 1, wherein a cup size marker is provided on the second band, which is preferably located on an exterior surface of the first part of the second band.

6. The measuring device of claim 1, wherein one or more cup size markers are provided on the second band, preferably adjacent to the band size indicia.

7. The measuring device of claim 6, wherein the cup size indicia and the one or more cup size marker are configured to lie adjacent to each other in the post-measurement configuration.

8. The measuring device of claim 1, wherein the band size indicia are located on an exterior surface of the second part of the second band.

9. The measuring device of claim 1, wherein the band size indicia are located on an exterior surface of an extension panel depending from the second part of the second band.

10. The measuring device of claim 1, further including a band size marker to indicate the user's band size on the band size indicia on the second band.

11. The measuring device of claim 10, wherein the band size marker is located on an exterior surface of the first part of the second band.

12. The measuring device of claim 1, wherein the second parts of the bands and the second ends of the first parts of the bands are laid flat in the post-measurement configuration to determine the user's band cup size.

13. The measuring device of claim 1, wherein additional size indicia are provided on the first, second or third bands.

14. The measuring device of claim 1, wherein the band attachment means comprises a hook-and-loop attachment system.

15. The measuring device of claim 1, wherein the panel is separable into two panel parts by means of a zipper.

16. The measuring device of claim 1, wherein one or more of the bands are provided with attachment means on their exterior surfaces for the attachment of one or more additional markers.

* * * * *